US005257488A

United States Patent [19]

Candusso

[11] Patent Number: 5,257,488

[45] Date of Patent: Nov. 2, 1993

[54] PROFILE IN BENDABLE METAL-WOOD AND THE PRODUCTS OBTAINED WITH IT

[75] Inventor: Bruno Candusso, Monfalcone, Italy

[73] Assignee: Candusso F. LLI S.r.L. Bilicbora, Monfalcone, Italy

[21] Appl. No.: 766,230

[22] Filed: Sep. 27, 1991

[30] Foreign Application Priority Data

Oct. 1, 1990 [IT] Italy ..... 83438 A/90

[51] Int. Cl.[5] ..... E06B 1/04

[52] U.S. Cl. ..... 52/212; 52/400; 52/656.2

[58] Field of Search ..... 52/456, 400, 213, 211, 52/212, 730, 656, 455; 49/504, 505

[56] References Cited

U.S. PATENT DOCUMENTS

| | | | |
|---|---|---|---|
| 3,204,324 | 9/1965 | Nilsen | 52/730 X |
| 3,512,304 | 5/1970 | Meuret | 52/456 |
| 4,005,558 | 2/1977 | Barrison | 49/504 X |
| 4,128,934 | 12/1978 | Doring | 52/730 X |
| 4,231,207 | 11/1980 | Kern et al. | 52/730 |
| 4,614,068 | 9/1986 | Bergthold | 52/730 X |
| 4,693,043 | 9/1987 | Knapp | 52/211 |
| 4,694,552 | 9/1987 | Ecker et al. | 49/504 X |
| 4,858,413 | 8/1989 | Grushka | 52/730 X |
| 5,072,547 | 12/1991 | DiFazio | 52/211 X |

FOREIGN PATENT DOCUMENTS

| | | | |
|---|---|---|---|
| 2447416 | 4/1976 | Fed. Rep. of Germany | 49/504 |
| 3425135 | 1/1986 | Fed. Rep. of Germany | 49/504 |

*Primary Examiner*—Carl D. Friedman
*Assistant Examiner*—Kien Nguyen
*Attorney, Agent, or Firm*—Edmund M. Jaskiewicz

[57] ABSTRACT

A Profile in metal (1) and wood (3) with the interposition of a binder layer (2), characterized in that the wood (3) is divided into a plurality of laths placed tightly one close to the other adjacents (31,32,33, . . . ) held together by at least said binder layer (2,2') conveniently elastic in order to consent a curvature of the entire profile with reciprocal longitudinal sliding between said laths of wood (31,32,33, . . . ).

2 Claims, 4 Drawing Sheets

PROFILE IN BENDABLE METAL-WOOD AND THE PRODUCTS OBTAINED WITH IT

The present invention regards a profile in bendable metal-wood and the products obtained with it, as frames for doors and windows, particularly those made with aluminium wood or with profiles having an aluminium structure or its alloys, coated at least on one side with wood.

In prior art a metal-wood profile of the same applicant is known particularly for the realization of frames, with reference to EP-0159458.

In this patent we prospect a solution to avoid the bending of the profile due to different dilatations of the materials by means of the use of a binder between aluminium and wood (for example polyurethane) which is held on the metal profile (aluminium) by means of undercuts and of which the aluminium surface was preventively coated with a lubricant or detacher that permits a free longitudinal sliding of the binder (polyurethane) and consequently of the wood firmly tied to the polyurethane binder, in respect to the metallic profile.

In such a way, being that the wood profile slides longitudinally in respect to the metallic profile, we avoid the differentiated stresses of dilatation and the profiles do not bend.

The necessity exists however in the fabrication of frames to bend the profiles or adapt them to a certain form of frames as for example curved frames (in a regular radius or irregular) and in this case it not is conveniently possible to realize said curvatures of profiles in metal-wood.

These frames were generally made with only wood by means of very expensive processes or with only a metallic profile by means of an adequate curvature of the same profile.

A further scope is however also to avoid joints at end of the curvatures, being that joints are notoriously very expensive.

It is also known that while there are many pliable metals that can be easily bent (e.g. aluminium) it is also known that in the case of wood the curvatures at the thicknesses required in these profiles are not possible unless one resorts to very slow and expensive processes of curvature, as steam impregnation at high temperatures, deformation, desiccation and cooling.

Consequently frames in metal wood until today were obtained by means of cutting them and by respective junctions in boards.

The scope of this invention is to avoid these said drawbacks.

This and other scopes are reached with the present invention as from the claims, by means of a profile in metal and wood with the interposition of a binder, characterized in that the wood is divided in a plurality of laths placed tightly one against the other, adjacents held together by said convenient elastic binder.

With this solution it is possible to bend the profile to form a right angle in the respective wood laths without using joints or breaking the respective wood coating formed by these laths and with consequent considerable advantages if compared to the traditional expensive solutions that not only need a complex procedure but also varnishing successive to obtaining the curved element, etc.

The invention is better understood with the enclosed description and data supplied only for example, in which.

Making reference to the illustrations it is disclosed that the profile includes an aluminium profile (1) to which by means of the polyurethane binder (2,2') we anchor a plurality of laths of wood (3.1,3.2,3.3 . . . ) to form the required wood coating (3 ).

Figure 1:
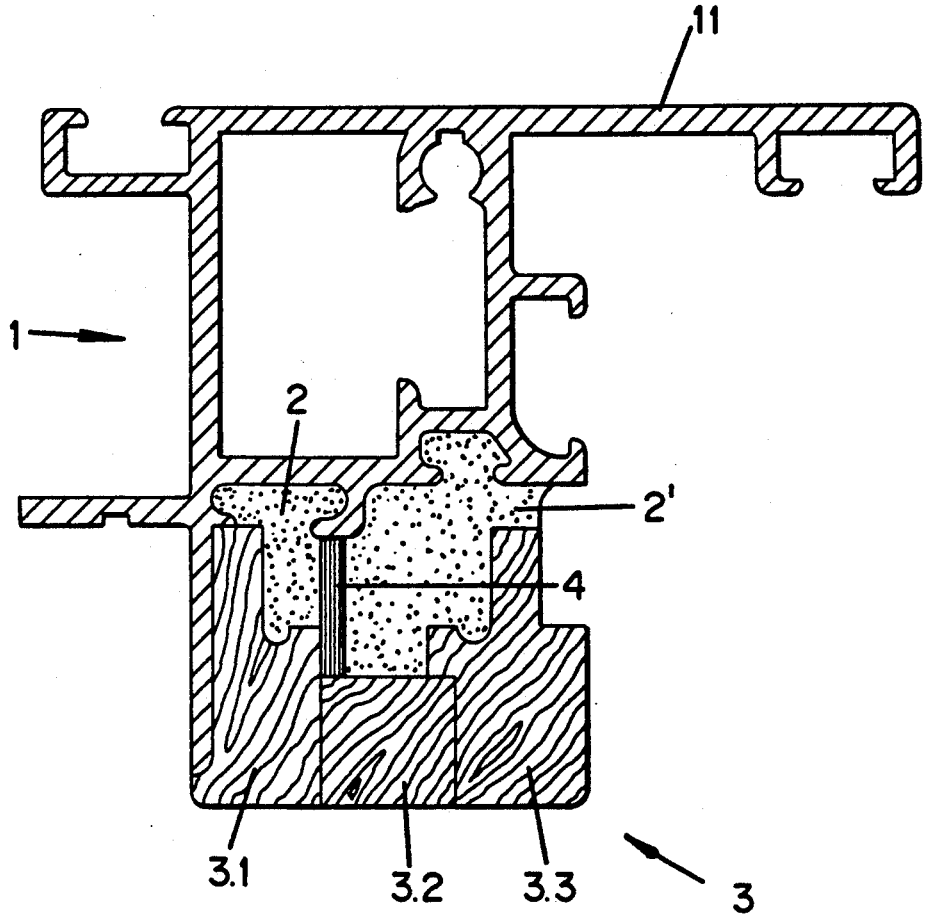
FIG. 1 represents a view in cross section of a first metal and wood profile according to the invention.
Figure 2:
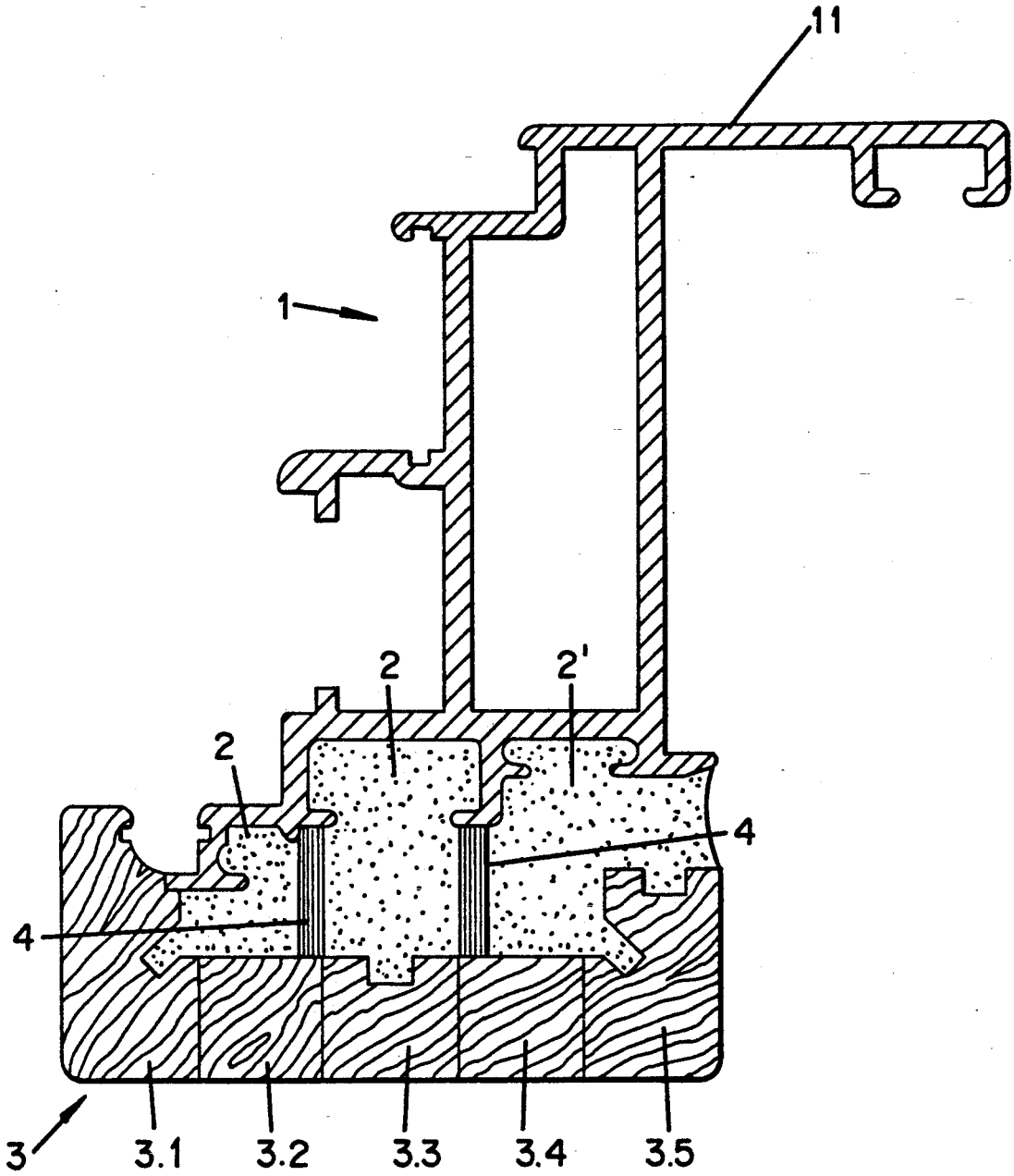
FIG. 2 represents a view in cross section of a second metal and wood profile according to invention.

The realization process consists particularly in the following:

- apply a first lath 3.1 with the respective polyurethane binder to profile 1 according to the prior art for example in the cited EP-0159458.;
- carry out a milling of the internal surface of the binder 2 and of the profile 3.1 to form a right angle in the lath pending on the curvature surface.
- apply a detaching lath in the zone of the binder (4) said detaching lath will be made with flexible material and compatible with the binder as for example the PVC.
- apply a successive lath (3.2) tied with the binder as in the first (3.1).
- repeat the operations as above until coated completely (3.3 FIG. 1 or 3.5 FIG. 2 with the last layer in binder stratum 2').
- proceed to the curvature of the profile as eventually desired.

The compression of the internal wing 11 of the metallic profile 1 can be contained by means of techniques of clamping between the dies noted during the curvature phase.

In processes in which one wishes that the laths of wood form a unique body, we provide, in the application of the same, to interpose a glue that works very slowly and before it takes effect we proceed to the bending.

In substance the inventive principle is based on the fact that to avoid the wood breaking during the curvature of the profile, it is necessary that:

- the wood coating 3 is carried out with a plurality of profiles and sliding is possible between these.

Figure 3:
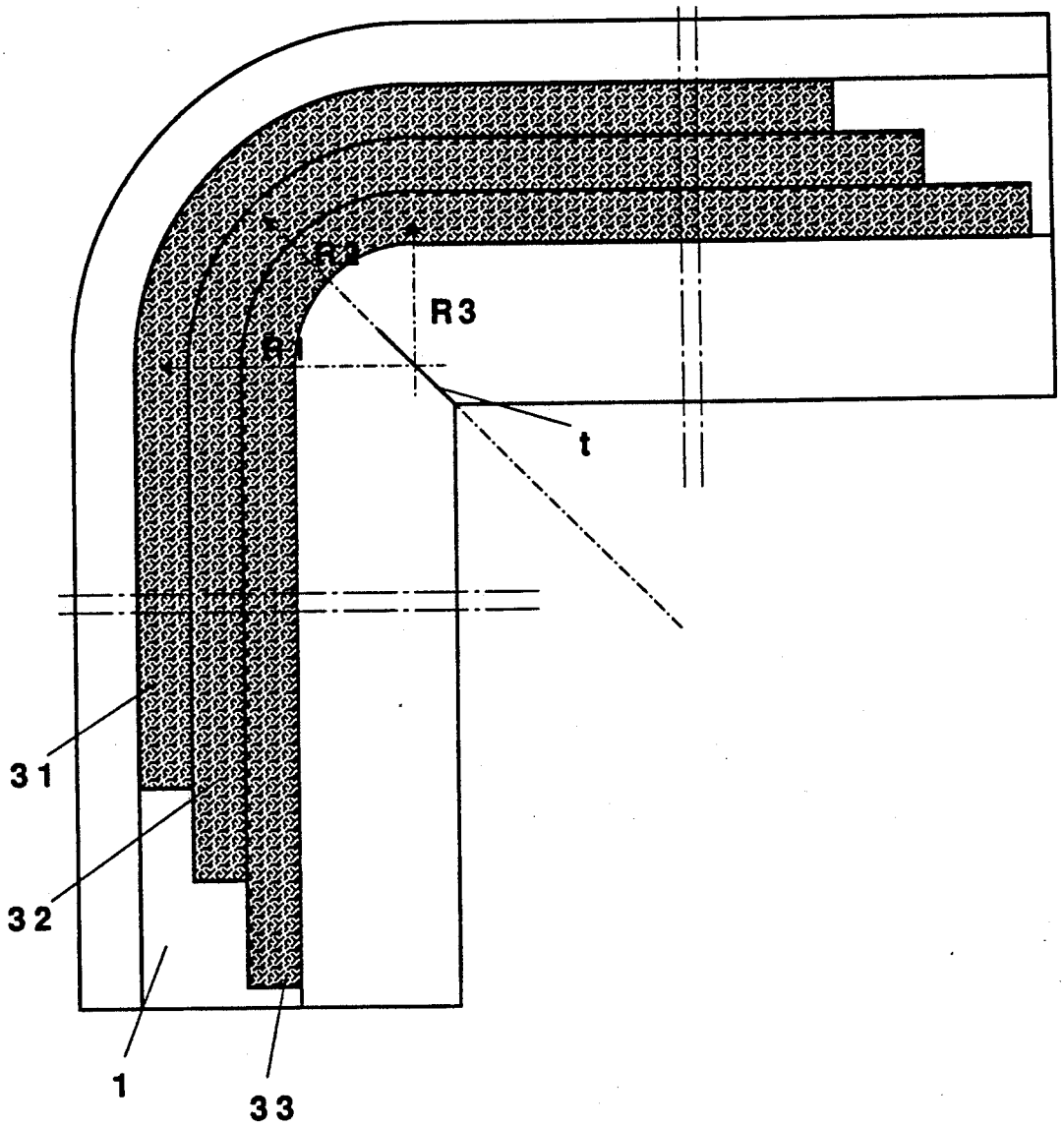
FIG. 3 represents a frontal view of a curve limit with a very narrow radius, almost a sharp corner to see better the sliding and slippage of the respective laths of the disjoined wood according to invention.
Figure 4:
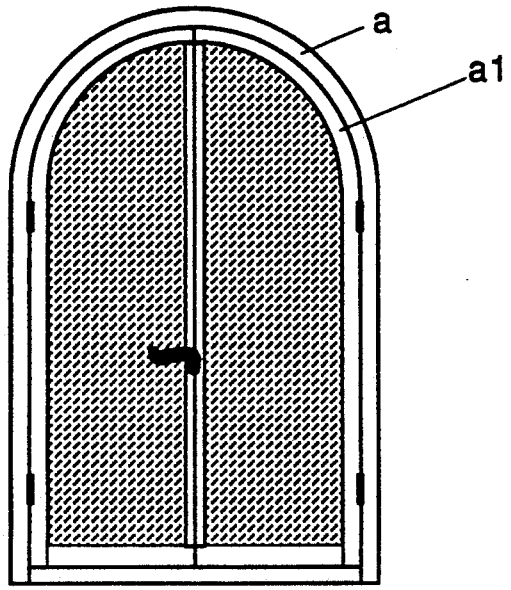
FIGS. 4, 5, 6, 7, represent some forms of frames, now possible with profiles in metal-wood according to this invention.
Figure 5:
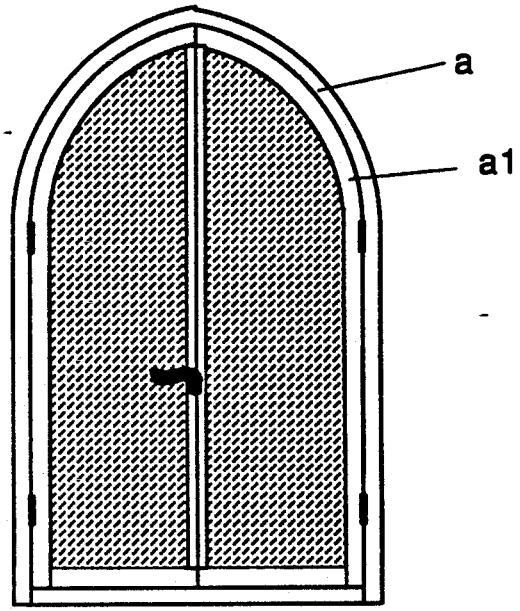
Figure 6:
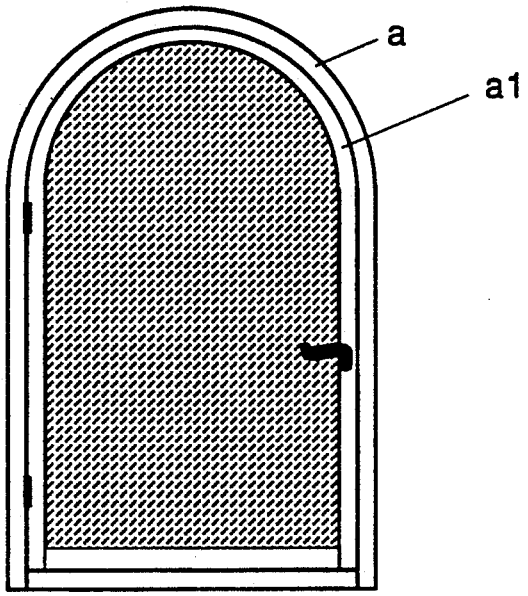
Figure 7:
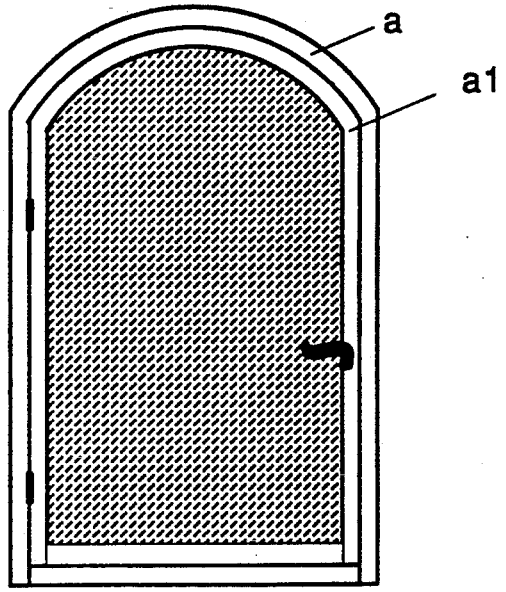

In fact, taking for example a curve limit, as indicated in FIG. 3, the external profile will curve at a radius (R1) greater than the median profile (R2) and the last greater than that interior one (R3) etc.

Consequently while curving they must slide one against the other moving progressively to the end , re-entering towards the external as indicated in FIG. 3.

The reduced thickness of each wood lath will prevent them from breaking during the curvature.

The ends with re-entering profiles can then be cut as discard.

They are held together by the underlying binder (2—2' in the limit of their gluing by using a glue with a delayed effect in a way that the definate fixation can happen after the bending.

For such scope there are known binders with a delayed effect which effect can happen when one wishes, according to the composition and addition of the respective delayers.

Of course between the adherent surfaces of the laths of wood the glue with a delayed effect could also be omitted.

According to FIGS. 4, 5, 6, 7 one sees that with this solution it is possible to obtain frames with a curve or an arch (a ), of which arch can be of any form and with only one radius or with a differentiated radius, for example an arch of 180° or less, pointed arch etc. and the windows can obviously have a double or single door etc.

With this solution it is possible to realize any arch form (a) to arrive at the limit also for the realization of curves with right angles and minimum radius for specific usages as for example indicated in FIG. 3, therefore within the limits also to avoid corner joints.

In the case of windows with arches, they will obviously have frame arches (a) that include an entire curvature and door arches that include a portion of said curvature (a1 ).

The solutions are however infinitive and we do not need to linger on this subject.

I claim:

1. A profile comprised of a metal profile and a wood profile with the interposition of a binder, characterized in that said wood profile is divided into a plurality of laths placed tightly one close to the other adjacent in order to permit a curvature of the entire profile with reciprocal longitudinal sliding between said laths of wood; at least one layer of detaching material placed in said binder and between said wood profile and said metal profile, said at least one layer of detaching material dividing said binder into layers so that said binder layers are able to scroll longitudinally one against the other during the curvature of the entire profile.

2. A Profile according to claim 1 further characterized in that between said laths of wood a glue is placed which has a delayed effect and will take effect only after the curvature of the entire profile occurs.

* * * * *